United States Patent [19]

Göthberg

[11] Patent Number: 4,616,479

[45] Date of Patent: Oct. 14, 1986

[54] POWER CONTROL SYSTEM FOR A DOUBLE-ACTING HOT GAS ENGINE

[76] Inventor: Yngve R. Göthberg, Storabackegatan 15 D 216 15, Malmö , Sweden

[21] Appl. No.: 801,963

[22] Filed: Nov. 26, 1985

[51] Int. Cl.[4] ..... F02G 1/06

[52] U.S. Cl. ..... 60/521; 60/525

[58] Field of Search ..... 60/517, 521, 522, 525

[56] References Cited

U.S. PATENT DOCUMENTS

| | | | |
|---|---|---|---|
| 3,372,539 | 3/1968 | Reinhoudt | 60/521 |
| 3,859,792 | 1/1975 | Reinink | 60/521 |
| 3,927,529 | 12/1975 | Hakansson | 60/521 |
| 4,417,444 | 11/1983 | Lundholm | 60/525 |

*Primary Examiner*—Stephen F. Husar

*Attorney, Agent, or Firm*—Finnegan, Henderson, Farabow, Garrett & Dunner

[57] ABSTRACT

The invention relates to a power control system for a hot gas engine in which the power depends on the mean working gas pressure in the engine. Said engine is of the type having an even number of working gas charges separated by pistons each having two axially displaced piston rings. Said piston rings and their piston ring grooves are shaped to act as check valves and so that in each other piston the space between the piston rings will contain gas of maximum working cycle pressure whereas in the remaining pistons it will be minimum working cycle pressure.

3 Claims, 4 Drawing Figures

POWER CONTROL SYSTEM FOR A DOUBLE-ACTING HOT GAS ENGINE

This invention relates to a power control system for a double-acting hot gas engine.

BACKGROUND OF THE INVENTION

Double-acting hot gas engines generally comprises three or more working gas charges each of which are cyclically compressed at low temperature, heated, expanded at high temperature and cooled. The work performed during a working cycle is almost proportional to the amount of working gas in the charge.

Therefore, it is common practise to vary the amount of working gas in each working gas charge in order to govern the power output—e.g. in case the engine speed and the engine temperatures should be kept nearly constant.

The U.S. Pat. No. 3,927,529 shows a power control system of this known type. In order to avoid interconnections between the various working gas charges of the engine while being able to perform a simultaneous gas supply or gas removal by means common to all working gas charges, the gas supply system should comprise two check valves at each connection to a part of the working gas charge limiting device—e.g. the cold gas connection duct between the low temperature part of the cylinder and an adjacent cooler.

It is also known from the U.S. Pat. No. 3,927,529 to provide each piston with two piston rings each of which allowing flow of gas in one direction only across the piston ring. A minimum working cycle gas pressure will prevail in the space between the two piston rings in case both piston rings allow gas flow only away from said space. The two piston rings act as check valves and the purpose is to maintain an equal mean pressure in all working gas cycles of the engine.

The U.S. Pat. No. 4,417,444 shows a double-acting hot gas engine having axially spaced piston rings at each piston. The axial distance is greater than the piston stroke and a connection is established between the space between the piston rings and a source of gas having minimum or maximum pressure. Again the purpose is to maintain equal pressures in working gas charges.

OBJECT AND SUMMARY OF THE INVENTION

The object of the present invention is to provide a power control system which is based upon varying the amount of working gas in the working gas charges, but in which the check valves in the gas supply and dump system may be dispensed with. Said check valves contribute to the number of moving parts in the engine and require maintenance and represents a risk of leakage and performance losses.

According to the present invention a power control system for a double-acting hot gas engine having an even number of working gas charges each of which being limited by reciprocating pistons in two cylinders and each of said pistons being provided with two axially spaced piston rings allowing flow of gas to pass each ring in one direction only is according to the invention characterised in that a first one of two piston limiting a working gas charge is provided with piston rings adapted to provide maximum working gas pressure between them, whereas the other one of said two pistons is provided with piston rings adapted to provide minimum working gas pressure between them, a controllable connection being established from a high pressure gas source to the space between the piston rings of said other one of said two pistons, whereas another controllable connection is established from the space between the piston rings of said first one of said two pistons to a low pressure gas source.

DETAILED DESCRIPTION

Figure 1:
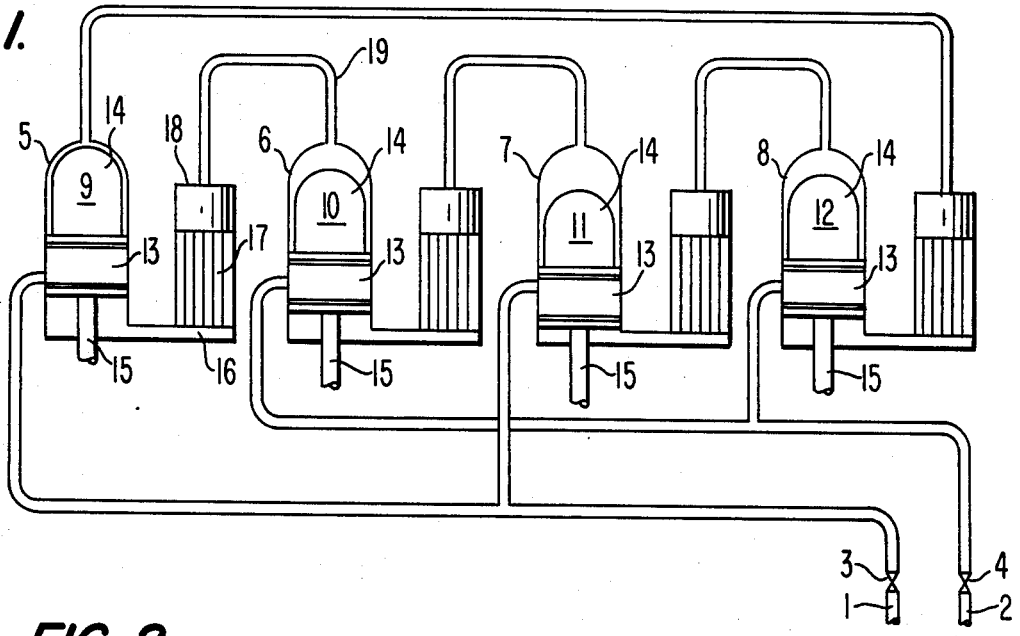
FIG. 1 shows schematically the working gas system of a four-cylinder, double-acting hot gas engine having a power control system according to the invention.

The working gas system shown in FIG. 1 comprises a conduit 1 connected to a gas source of minimum gas pressure (not shown). Said source may be e.g. the suction side of a compressor.

Another conduit 2 is connected to a gas source of maximum pressure (not shown). Said source may be a storage tank connected to the delivery side of a gas compressor. The gas referred to above should be suitable as working gas in a hot gas engine and as is commonly known in the art said gas should have small molecules in case the engine should have a high specific power output. Usually hydrogen or helium are used.

The tubes 1 and 2 are provided with adjusting valves 3 and 4 respectively.

The relevant parts of the hot gas engine are four cylinders 5–8 each containing a piston 9–12 respectively. Each piston comprises a generally cylindrical part 13 carrying a dome 14 at one end and a piston rod 15 at the other end.

The pistons in two neighbouring cylinders influence a charge of working gas. E.g. the lower side of the piston part 13 in the cylinder 1 acts upon a working gas charge located in the cylinder 5 below the piston part 13 and in the cylinder 6 above the dome 14 of the piston 10 as well as in connecting ducts 16–19. Said ducts represent the following elements as is well known in the art: A cold gas connecting duct 16, a cooler 17, a regenerator 18 and a heater 19.

The piston rods 15 and connected to a crank shaft mechanism (not shown) in which the cranks are 90 degrees angularly spaced.

It will be understood that due to the angular displacement of the cranks each piston of the four cylinders will move cyclically with 90 degrees displacement relative its neighbouring pistons. This will cause one compression and one expansion of each working gas charge during each revolution of the engine. The direction of rotation is such that each working gas charge mainly is located in the high temperature engine parts—i.e. the heater 19 and the space above the dome 14—during expansion, whereas each charge of working gas is located in the low temperature engine parts—i.e. the cooler 17 and the space below the piston part 13—during the compression.

As each working gas charge is compressed at low temperature and expanded at high temperature the engine will produce power.

The power output is nearly proportional to amount of working gas in the four working gas charges.

Figure 2:
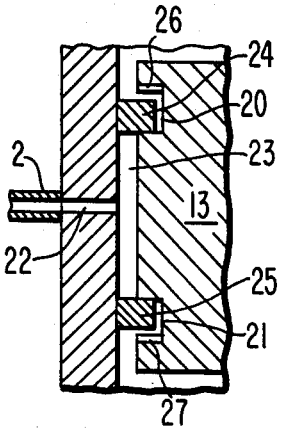
FIG. 2 is a vertical section through a part of a piston of the engine and an adjacent cylinder wall—shown at a larger scale.

The pistons in the cyclinders 6 and 8 (which an 180 degrees cyclically spaced) are provided with piston parts 13 having piston ring grooves as shown in FIG. 2. The two grooves are designated by the reference numerals 20 and 21. They are axially spaced through a distance greater than the piston stroke. This makes it possible to maintain a connection between an opening 22 in the cylinder wall and the space 23 between the cylinder wall and the piston limited by two piston rings 24 and 25 in the grooves 20 and 21 respectively.

The piston rings 24 and 25 are loosely fitted in the grooves in the axial direction. The grooves 20, 21 are also provided with radially extending channels 26 and 27 respectively outside the piston rings 24, 25. Piston having such grooves and such piston rings have been described e.g. in the U.S. Pat. No. 3,927,529.

Working gas may therefore always pass to the space above the piston part 13 through the channels 26 via the inner part of the groove 20 behind the ring 24.

Working gas may also always pass to the space below the piston part 13 through the channels 27 via the inner part of the groove 21 behind the ring 25.

Consequently the gas pressure in the space 23 will correspond to the minimum pressure of the cyclically varying pressures of the two working gas charges separated by the piston part 13.

The opening 22 is connected via the conduit 2 to a maximum gas pressure source. Therefore, if the valve 4 is opened, gas till pass to the space 23 and into the working gas charges separated by the piston part 13.

Figure 3:
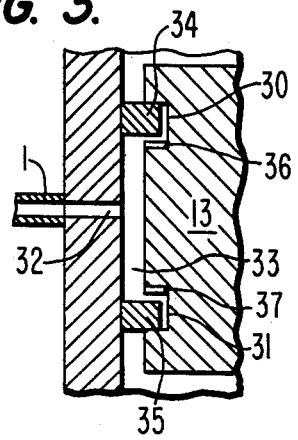
FIG. 3 is similar to FIG. 2, but shows a different piston of the same engine.

FIG. 3 depicts the pistons of the cylinders 5 and 7. The piston part 13 is provided with grooves 30 and 31 adapted to receive piston rings 34, 35 leaving a spaced 33 between them. Said space 33 is always in connection with an opening 32 in the cylinder wall and said opening 32 is connected to the conduit 1 having gas draining ability. The grooves 30 and 31 are provided with radially extending channels 36 and 37 respectively allowing gas to pass from the working gas charges separated by the piston to the space in each groove 30, 31 behind the piston ring 34, 35 and into the space 33.

Therefore, the space 33 will always contain gas of maximum working gas pressure.

If the pressure in the space 33 is lowered by opening the valve 3 of FIG. 1 the maximum pressure of the cycling working gas pressure will thus be lowered corresponding to a decreasing amount of working gas in the engine.

Figure 4:
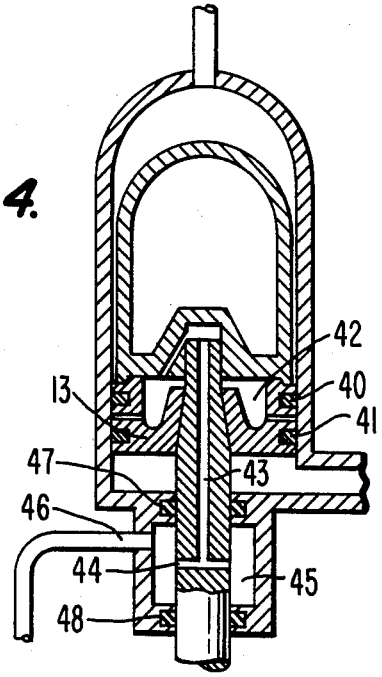
FIG. 4 is a vertical section through a cylinder of another engine having a power control system according to the invention, but having a small axial spacing of the piston rings.

FIG. 4 shows how the axial length of the piston parts 13 may be decreased by decreasing the axial distance between the piston rings 40 and 41. The space between the piston rings 40, 41 is connected to a chamber 42 in the piston part 13. Said chamber 42 is in turn connected to an axial, central bore 43 which at radial bores 44 is connected to a chamber 45 having an axial length greater than the piston stroke. Said chamber 45 is provided with an opening 46 corresponding to the openings 22 and 32 of FIGS. 2 and 3. Piston rod seals 47 and 48 are surrounding the piston rod and are axially spaced and located to ensure that the bores 44 always will be located between the seals 47 and 48 regardless of the position of the piston rod. It will be understood that the design of FIG. 4 allows a shorter piston and cylinder design.

What is claimed is:

1. A power control system for a double-acting hot gas engine having an even number of working gas charges each of which being limited by reciprocating pistons in two cylinders and each of said pistons being provided with two axially spaced piston rings allowing flow of gas to pass each ring in one direction only characterized in that a first one of two pistons limiting a working gas charge is provided with piston rings adapted to provide maximum working gas pressure between them, whereas the other one of said two pistons is provided with piston rings adapted to provide minimum working gas pressure between them, a controllable connection being established from a high pressure gas source to the space between the piston rings of said other one of said two pistons, whereas another controllable connection is established from the space between the piston rings of said first one of said two pistons to a low pressure gas source.

2. A power control system according to claim 1 characterized in that said two piston rings in a piston are axially spaced through a distance greater than the piston stroke and that an opening in the adjacent cylinder wall is located so as to communicate with the space between the piston rings regardless of the axial position of the piston.

3. A power control system according to claim 1 characterized in that the space between the piston rings is connected to a hollow part of the piston connected to an axial bore in the piston rod and that said axial bore is provided with a radial bore to the piston rod surface, said piston rod being surrounded by seals being axially spaced through a distance exceeding the piston stroke.

* * * * *